United States Patent [19]

Silva et al.

[11] Patent Number: 4,751,642

[45] Date of Patent: Jun. 14, 1988

[54] INTERACTIVE SPORTS SIMULATION SYSTEM WITH PHYSIOLOGICAL SENSING AND PSYCHOLOGICAL CONDITIONING

[76] Inventors: John M. Silva, Rte. 2, 205 Cascade Dr., Falls of New Hope, Chapel Hill, N.C. 27514; R. Kelly Crace, 4901 Marlborough Way, Durham, N.C. 27713

[21] Appl. No.: 902,142

[22] Filed: Aug. 29, 1986

[51] Int. Cl.[4] ..... A63F 9/00; G06F 15/00; A63B 67/00

[52] U.S. Cl. ..... 364/413; 364/410; 273/55 R; 273/85 G; 273/185 A; 273/185 B

[58] Field of Search ..... 364/410, 413; 273/176 L, 176 FA, 183 R, 184 R, 185 A, 185 B, 55 R, 85 G; 128/730–732

[56] References Cited

U.S. PATENT DOCUMENTS

| | | | |
|---|---|---|---|
| 3,655,202 | 4/1972 | Gautraud et al. . | |
| 3,729,315 | 4/1973 | Conklin et al. . | |
| 4,029,315 | 6/1977 | Bon | 273/183 R |
| 4,086,630 | 4/1978 | Speiser et al. . | |
| 4,149,716 | 4/1979 | Scudder | 273/85 G |
| 4,150,825 | 4/1979 | Wilson . | |
| 4,160,942 | 7/1979 | Lynch et al. . | |
| 4,278,095 | 7/1981 | Lapeyre . | |
| 4,358,118 | 11/1982 | Plapp | 273/85 G |
| 4,437,672 | 3/1984 | Armantrout et al. . | |
| 4,695,953 | 9/1987 | Blair et al. | 273/85 G |

*Primary Examiner*—Jerry Smith
*Assistant Examiner*—Allen MacDonald
*Attorney, Agent, or Firm*—Richard E. Jenkins

[57] ABSTRACT

Interactive sports simulation system for providing an actual physical trial of the sports performance to be enacted. The system includes audiovisual means for simulating an actual competitive sports environment, sensors for measuring the sports performance and physiological performance of an athlete being tested, and computer means responsive to the performance data from the sensors for controlling the simulated sports environment created by the audiovisual means. The system facilitates psychological conditioning of the athlete through psychophysiological manipulation of the environment by the athlete.

15 Claims, 2 Drawing Sheets

INTERACTIVE SPORTS SIMULATION SYSTEM WITH PHYSIOLOGICAL SENSING AND PSYCHOLOGICAL CONDITIONING

DESCRIPTION

1. Technical Field

The present invention relates to apparatus for simulating a sports activity, and more particularly an interactive sports simulator system which provides an actual physical trial of the sports performance to be enacted.

2. Background Art

Numerous systems and apparatus have been proposed for simulating sports activities such as golf, but applicant does not believe that any of the systems known to date provide the interactive simulated sports experience of the instant invention. The expanded capability of the instant sports simulation system allows sport psychologists the opportunity to expand psychological training programs for athletes beyond the present state of the art in the field of sport psychology.

U.S. Pat. No. 4,278,095 to Lepeyre discloses a user controlled aerobic exercise system which allows the user to select an exercise program within a programmed heart beat range. The system includes a user powered exercise mechanism, a TV monitor which provides an exercising scene generated by a VCR, and a speed control which adjusts the exercise activity speed on the monitor to correspond to changes in exercise speed of the user on the exercise mechanism. A heart beat sensor is connected to the user for continuous display of his pulse rate on the monitor in conjunction with the exercise scene in order that the user may adjust the exercise activity in order to maintain his pulse rate within a predetermined range. This system is interactive to the extent that the exercise scene speeds up and slows down in accordance with increases and decreases, respectively, in the exercise activity rate of the user. U.S. Pat. No. 4,160,942 to Lynch et al. teaches a golf ball trajectory presentation system including electro-optical sensors for monitoring initial values for velocity, launch angle and spin velocity of a golf ball driven off a tee toward a screen upon which a fairway image is projected. A trajectory calculator computes the flight trajectory data which is then sent to a projector which projects an image of the golf ball onto the golf fairway scene on the screen in order to indicate the placement of the ball subsequent to the drive. Other exemplary prior art patents relating to golf game simulating apparatus include U.S. Pat. No. 4,437,672 to Armantrout et al., U.S. Pat. No. 4,150,825 to Wilson, U.S. Pat. No. 4,086,630 to Speiser et al., U.S. Pat. No. 3,729,315 to Conklin et al. and U.S. Pat. No. 3,655,202 to Gautraud et al.

Although all of the aforementioned prior art relating to sports simulation systems is of interest, none of the systems found therein are believed to provide for the psycho-physiological manipulation of the environment by the user in order to impart a desired psychological conditioning to the user.

DISCLOSURE OF THE INVENTION

In accordance with the present invention, applicant provides an interactive sports simulation system which allows a user the opportunity to be exposed to a true competitive sports situation in a controlled environment. The interactive sport simulation system should allow sport psychologists an opportunity to develop and expand psychological training programs for athletes beyond the present state of the art in the field of sport psychology.

As will be appreciated by those knowledgeable in the sport psychology field, current psychological interventions in sport psychology rely heavily upon the use of guided imagery experiences. A guided imagery experience is normally considered to be the mental rehearsing of the activity to be performed in actual sports competition by the athlete. The rehearsed sports experience is designed to pattern or render mentally routine the exact behaviors and coping strategies which the athlete desires to exhibit in competition. The guided imagery experience procedure develops a habit strength or behavioral tendency which increases the likelihood of a correct response being exhibited in actual sports competition. However, guided imagery techniques are dependent upon the athlete being able to visualize and control the scenes created for the athlete by the sport psychologist. In this regard, research has demonstrated considerable variability in a subject's ability to develop and control vivid images of complex interactional scenes such as a fast break in basketball and the like. Also, other important cues existing in the actual competitive situation being simulated (such as crowd distractions and auditory cues) are generally not present in guided imagery techniques.

Therefore, applicant's interactive sports simulator system is intended to provide a more vivid and realistic psycho-physiological conditioning paradigm for the athlete by simulating with both visual and auditory cues the actual competitive environment of the simulated sports activity and providing an actual physical trial of the performance to be enacted. The system includes visual imagery which is projected onto a screen and accompanied by corresponding audio, sensor means for monitoring both the actual sports performance of the player and his accompanying physiological performance, and computer means responsive to the performance and physiological data which simultaneously controls the audiovisual simulated sports activity dependent upon the nature of the data. Also, means are provided to make an audiovisual record of the performance as well as a record of the data generated thereby. In this fashion the system provides for the psychological conditioning of the user toward a true competitive environment that changes according to the psycho-physiological response of the user.

The sports simulation system thereby provides a combination of benefits not heretofore available. First, the user will be provided with an opportunity to exhibit his skills with audio and visual feedback being provided to him in a real-life setting. Second, the sports simulator system is able to monitor psycho-physiological and performance data and adjust the simulated sports activity in response thereto. This provides for an expansion and improvement in current psychological training programs for athletes. Finally, the sports simulation system provides the user with an opportunity to study his particular performance data including an audiovisual recording of the event and performance and psycho-physiological recorded data relating thereto.

Therefore, it is a general object of the present invention to provide a novel sports simulator system.

It is a further object of the present invention to provide an interactive sports simulation system which is responsive to performance and psycho-physiological data from the user.

It is another object of the present invention to provide a sports simulation system which provides for the psycho-physiological manipulation of the environment by the user in order to impart a desired psychological conditioning to the user.

It is still another object of the present invention to provide a sports simulation system of an improved nature in order to allow sport psychologists an opportunity to expand psychological training programs for athletes.

BRIEF DESCRIPTION OF THE DRAWINGS

Some of the objects of the invention having been stated, other objects will become evident as the description proceeds, when taken in connection with the accompanying drawings in which.

BEST MODE FOR CARRYING OUT THE INVENTION

The invention as disclosed herein is best understood by reference to the figures wherein like parts are designated with like numerals throughout.

Figure 1:
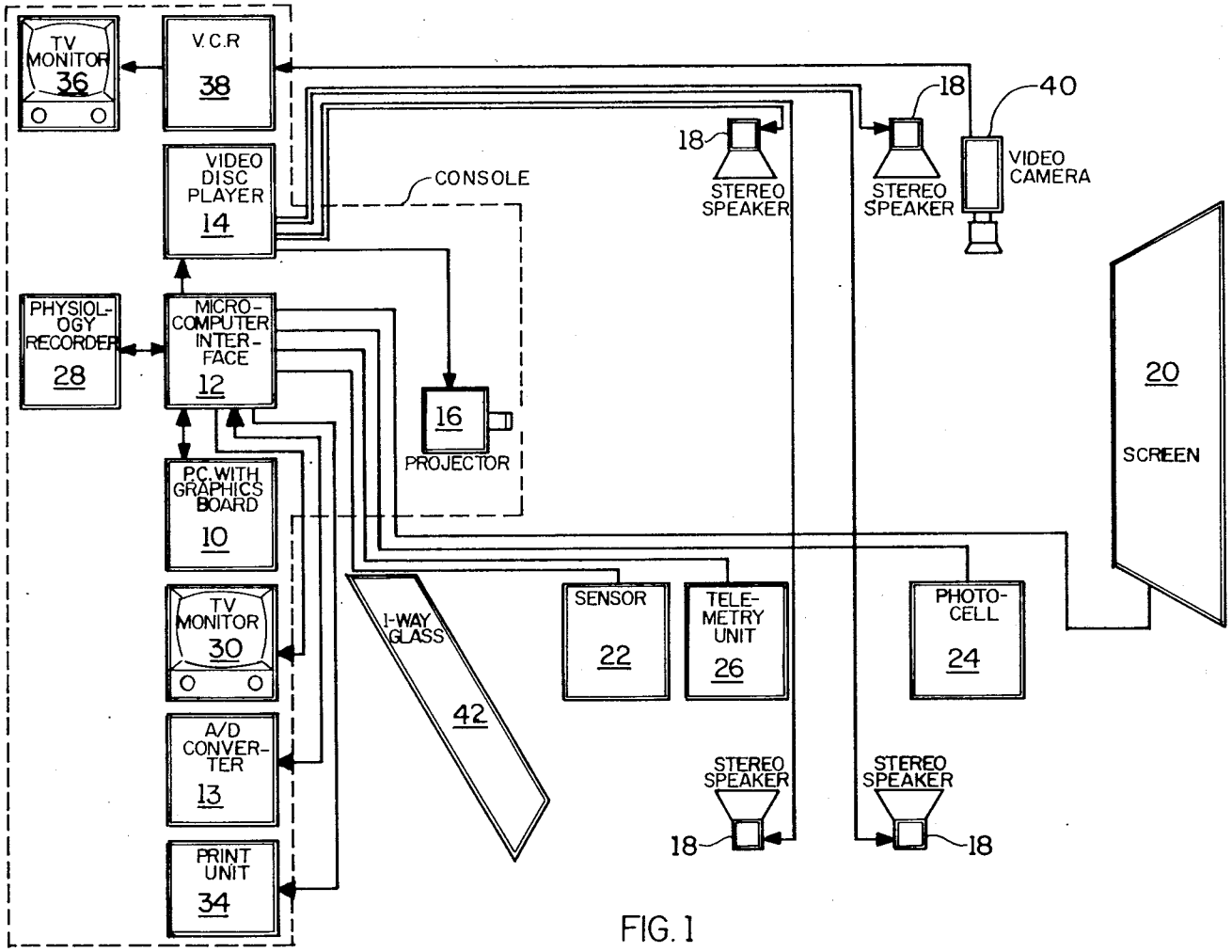
FIG. 1 is a block diagram showing the interrelationship of the principle electrical and electro-mechanical elements of an interactive sports simulator system constructed in accordance with the principles of the present invention.

Referring now to FIG. 1, an exemplary embodiment of an interactive sports simulation system for a football place kicker made according to the invention is illustrated in the figure and includes a personal computer 10 with a graphics board and an electrically connected microcomputer interface 12. An analog-to-digital converter 13 is electrically connected to interface 12 and provides for converting analog to digital data as needed. A video disk player 14 is connected to computer 10 at interface 12, and a video projector 16 and stereo speakers 18 are operatively connected to video disk player 14 in order to provide an audiovisual simulation of a selected sporting event which has been recorded onto a video disk. Also, a grid-sensored screen 20 is connected to interface 12 and positioned so that the visual image from projector 16 will be focused upon the surface thereof. Grid-sensored screen 20 is most suitably constructed of a metal support frame having a concave shape, an electrically sensored grid affixed to the support frame and electrically connected to interface 12 of computer 10, and a protective polyurethane covering provided over the grid in order to protect the grid and frame from damage due to ballistic impact of sports objects such as a football. The grid serves to pinpoint the location where the football contacts screen 20 and then convey the data to computer 10 through interface 12. These particular recited elements comprise the portion of the system for creating visual imagery with accompanying audio of a simulated sports event which an athlete will be subjected to and interact with in a simulated sporting event. It should be appreciated that computer 10 through interface 12 controls the visual image created by projector 16 on screen 20 and the audio from speakers 18 which corresponds to the imagery on the screen, and that computer 10 is directly responsive to the physiological input from the athlete.

In order to determine both the sports performance of the athlete and his psycho-physiological reaction to the simulated sports event, sensor pad 22 is utilized to detect the initiation of the sports performance. If the simulated sports event is a field goal kick as in the embodiment of the invention described herein, the sensor pad would be connected to the football tee. A photocell 24 is provided to detect the football in flight. Sensor pad 22 and photocell 24 are both connected to computer interface 12 and serve to provide data to computer 10 with respect to the trajectory, distance, velocity and accuracy of the sports performance. In addition to the sports performance indicators, a telemetry heart rate unit 26 and a physiology recorder 28 are connected to computer interface 12 in order that telemetry unit 26 connected to the athlete will monitor his psycho-physiological responses during the simulated sports event and the data will be visually displayed and recorded on physiology recorder 28. The aforementioned performance monitoring components of the system allow computer 10 to analyze actual performance and psycho-physiological data from the athlete being evaluated and make corresponding and almost simultaneous adjustments to video disk player 14 in order that the stress imposed upon the athlete by the simulated sports event may be either increased or decreased in accordance with a predetermined program in computer 12.

In order to facilitate analysis of the simulated sports performance, a first color television monitor 30 is connected to interface 12 and provides for visual monitoring of sports performance and psycho-physiological responses of the athlete. Finally, a printer 34 is connected to computer interface 12 and allows for hard copy reporting of sports performance and psycho-physiological performance responses of the athlete.

The interactive sports simulator system provides for continual monitoring of the simulated sports performance session on monitor 30 and also an opportunity for the athlete to review the session with ancillary monitoring equipment including a second color television monitor 36 which is electrically connected to a portable video cassette recorder 38 and video camera 40 which is directed at the subject during the course of the simulated sports performance. Also, a one way mirror 42 may be provided between the simulated sports activity room and a control room in order for simulation system technicians to observe the athlete's behavior.

Although other configurations are certainly possible, the embodiment of the present invention described herein contemplates that a control console positioned in a remote control room from the simulated sports activity room will include computer 10 and electrically connected interface 12, physiology recorder 28, video disk player 14, projector 16, first color television monitor 30, analog-to-digital converter 13 and hard copy printer 34. Also, second color television monitor 36 would be included in the console. One-way glass 42 would most suitable be positioned proximate to the console and in the wall between the control room and the simulated sports activity room.

Preferred equipment for use with the system of the invention include the following:

| Reference Number | Description |
|---|---|
| 14 | Pioneer Model LD700 Video Disk Player |
| 16 | Electrohome ECP 2000 Color/Data Graphics |

-continued

| Reference Number | Description |
|---|---|
| | Projection Monitor, Model 38-B05401-71 with ECP 2000 Ceiling Mount, Model 38-800203-66 |
| 20 | Concave Grid-Sensored Film Screen |
| 10 | IBM-XT Personal Computer with 512K Memory and Hercules Graphics Board |
| 12 | Lafayette Model 1180 Microcomputer Interface |
| 18 | Lafayette Model EV-13B 8 Ohm Stereo Speakers |
| 26 | AMF Quantum XL Telemetry Heart Rate Unit |
| 28 | Lafayette 4-Channel Physiology Recorder Model 76102 |
| 22 | Sensor-Lafayette 63100 Switch Mat |
| 24 | Lafayette Model 63501 Photocell Control System |
| 30, 36 | Sony 19" Color Television |
| 13 | Lafayette Model 1180-60 Analog-to-Digital Converter |
| 34 | Hewlett-Packard Laserjet Printer |
| 40 | Ikegami 79-E Video Camera |
| 38 | RCA Model VLP970 Portable Video Cassette Recorder |
| 42 | One-way Mirror |

Figure 2:
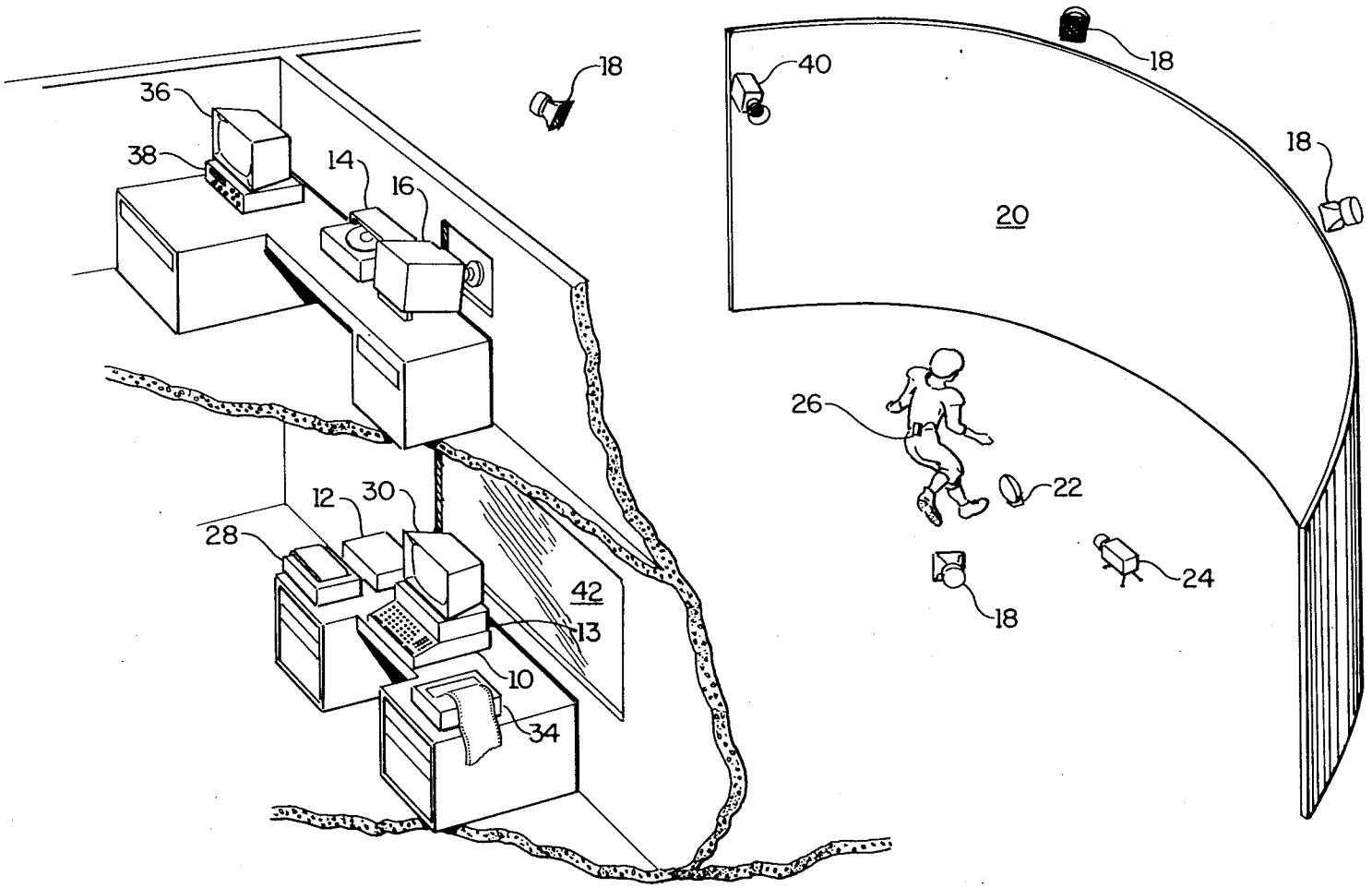
FIG. 2 is a perspective diagrammatic view of the interactive sports simulator system of FIG. 1.

In operation, as best appreciated with reference to FIG. 2, the interactive sports simulator system provides an athlete with an opportunity to be exposed to a true competitive situation in a controlled environment. The athlete would first enter a laboratory or testing site and a clinician would attach telemetry unit 26 to the athlete so that his psycho-physiology could be monitored during various phases of the sports performance. The physiological data is fed back to computer 10 which will control the amount of stress which is created by video disk player 14 and associated projector 16 and speakers 18. As presently contemplated, computer 10 will be programmed so that the stress created by video disk player 14 is related to the athlete's ability to control his physiology. For example, the less able the athlete is to control his psycho-physiology during the simulated sports activity, the more stressful will be the simulated sports activity which will be created by video disk player 14.

In the embodiment of the inventive sports simulation system of the invention depicted in FIG. 2, a field goal kicker A after being connected to the telemetry unit 26 would position himself behind a simulated line of scrimmage in a normal kicking position for a field goal. Sensor pad 22 is attached to the football support to detect when it is kicked. Field goal kicker A will prepare to kick the football toward screen 20 and through the detection field of photocell 24. As the field goal kicker prepares to kick the football, the distance of the field goal, the angle that he is kicking from, the score of the game and the time remaining are all data which would be visible to the kicker or made known to him through auditory information from video disk player 14. Thus, a total environment will be re-created through projected images from projector 16 onto screen 20 and auditory cues from speakers 18. Next, athlete A would line up and see on screen 20 the defensive line, the crowd, the officials and other pertinent visual and auditory cues provided by video disk player 14. Still further by way of explanation, it should be appreciated that athlete A would, for example, next see the offensive line lined up off to one side. The offensive line would then move over and take their position over the ball and athlete A would communicate with his holder as he would normally do in calling for the snap. Athlete A would actually see a ball coming toward the holder in the scene being projected onto screen 20. Movement and blocking in the offensive and defensive lines would be projected onto the screen. The football holder with sensor pad 22 secured thereto would hold the football in place as athlete A actually kicks the football into screen 20. Once intiation of the simulated sports activity takes place, sensor pad 22 and photocell 24 detect how long it took athlete A to get the kick off, what the speed and trajectory of the football was and, upon contact of the football with screen 20, a recording is made of how accurately the football was kicked. This data along with the psycho-physiological data provided by telemetry unit 26 is fed back to computer 10 and, upon demand, printed out in hard copy on printer 34. Athlete A and a clinician after completion of the sports activity may review the actual performance on TV monitor 36 and review sports performance and psycho-physiological performance data provided by printer 34.

Also, although the information which is projected onto the screen will normally be controlled by athlete A's physiology, the clinician may at any time manually override this information and either increase or decrease the stress being projected onto screen 20. The simulated sports activity described above may be re-created for virtually any sport and the same data generated and used for subsequent analysis and intervention.

Having shown and described a preferred embodiment of the present invention, by way of example, it should be realized that structural changes could be made and other examples given without departing from either the spirit or scope of this invention.

What is claimed is:

1. Apparatus for interactive sports simulation with a player comprising:

a projection screen;

means for forming a visual image on said screen of a simulated sports event and for providing audio corresponding therewith so that a player can carry out a simulated sports performance in response to said visual image and audio corresponding therewith;

first sensor means for monitoring the simulated sports performance of the player during the simulated sports event;

second sensor means for monitoring physiological performance of the player during the simulated sports performance; and computer means responsive to said first and second sensor means for analyzing data from said first and second sensor means and controlling said means for forming a visual image and for providing audio in response to the data.

2. Apparatus as defined in claim 1 further including a video camera and electrically connected VCR and television monitor to allow the player to review the simulated sports performance subsequent thereto.

3. Apparatus as defined in claim 1 further including a television monitor for visual monitoring of the simulated sports performance and physiological performance, an A/D converter for converting analog data to digital data, and a printer for hard copy reporting of simulated sports performance and physiological performance data, said monitor, A/D converter and printer each being electrically and independently connected to a microcomputer interface which is electrically connected to said computer means.

4. Apparatus as defined in claim 1 wherein said projection screen comprises a concave frame having a resilient screen secured thereto.

5. Apparatus as defined in claim 1 wherein said image forming and audio providing means comprises a video disk player and electrically connected video projector and speaker system, said video disk player being interfaced with said computer means.

6. Apparatus as defined in claim 5 wherein said speaker system comprises four stereo speakers.

7. Apparatus as defined in claim 1 wherein said first sensor means comprises at least one sensor member to detect initiation of the simulated sports performance, at least one electric photocell to detect progression of the simulated sports performance, and a sensor grid affixed to said projection screen to measure the sports performance, said sensor member, electric photocell, and sensor grid being interfaced with said computer means.

8. Apparatus as defined in claim 1 wherein said second sensor means comprises a telemetry heart rate unit and physiology recorder to monitor and record physiological performance of the player during the simulated sports performance, said telemetry unit and physiology recorder being interfaced with said computer means.

9. Apparatus as defined in claim 1 wherein said computer means comprises a personal computer and electrically connected graphics board and microcomputer interface.

10. Apparatus as defined in claim 9 wherein said personal computer has 512K of RAM memory.

11. Apparatus for interactive sports simulation with a player comprising:

a projection screen;

a video disk recorder;

projection means electrically connected to said video disk recorder for projecting visual images of a simulated sports event onto said screen;

audio means electrically connected to said video disk recorder for providing audio corresponding to said visual images being projected onto said screen so that a player can carry out a simulated sports performance in response to said visual images and audio corresponding therewith;

first sensor means for monitoring the simulated sports performance of the player during the simulated sports event;

second sensor means for moniotoring physiological performance of the player during the simulated sports event;

computer means responsive to said first and second sensor means for analyzing data from said first and second sensor means and controlling said video disk recorder to provide visual images and audio responsive to the simulated sports performance and physiological performance of the player;

a video camera and electrically connected VCR and first television monitor to allow the player to review the simulated sports performance thereafter; and a second television monitor, A/D converter and printer each being electrically and independently connected to a microcomputer interface which is electrically connected to said computer means to allow simultaneous monitoring of the simulated sports event and processing of data from said first and second sensor means.

12. Apparatus as defined in claim 11 wherein said first sensor means comprises at least one sensor member to detect initiation of the simulated sports performance, at least one photocell to detect progression of the simulated sports performance, and a sensor grid affixed to said projection screen to measure the sports performance, said sensor member, electric photocell, and sensor grid being interfaced with said computer means.

13. Apparatus as defined in claim 11 wherein said second sensor means comprises a telemetry heart rate unit and physiology recorder to monitor and record physiological performance of the player during the simulated sports performance, said telemetry unit and physiology recorder being interfaced with said computer means.

14. Apparatus as defined in claim 11 wherein said computer means comprises a personal computer and electrically connected graphics board and microcomputer interface.

15. Apparatus as defined in claim 14 wherein said personal computer has 512K of RAM memory.

* * * * *